US009272429B2

(12) United States Patent
Oki et al.

(10) Patent No.: US 9,272,429 B2
(45) Date of Patent: Mar. 1, 2016

(54) BREAD SLICING APPARATUS

(71) Applicant: Oshikiri Machinery Ltd., Fujisawa-shi (JP)

(72) Inventors: Yuzuru Oki, Fujisawa (JP); Masami Umetsu, Fujisawa (JP); Takahiro Hasegawa, Fujisawa (JP)

(73) Assignee: OSHIKIRI MACHINERY LTD., Fujisawa-Shi, Kanagawa-Ken (JP)

( * ) Notice: Subject to any disclaimer, the term of this patent is extended or adjusted under 35 U.S.C. 154(b) by 0 days.

(21) Appl. No.: 14/485,361

(22) Filed: Sep. 12, 2014

(65) Prior Publication Data

US 2015/0000496 A1 Jan. 1, 2015

Related U.S. Application Data

(63) Continuation of application No. 12/968,071, filed on Dec. 14, 2010, now Pat. No. 8,833,222.

(30) Foreign Application Priority Data

Jun. 7, 2010 (JP) ..... 2010-130432

(51) Int. Cl.
*B26D 1/48* (2006.01)
*B26D 1/50* (2006.01)
(Continued)

(52) U.S. Cl.
CPC .. *B26D 1/48* (2013.01); *B26D 1/50* (2013.01); *B26D 7/2614* (2013.01); *B26D 7/32* (2013.01);
(Continued)

(58) Field of Classification Search
CPC ..... B27B 13/00; B27B 13/02; B27B 13/08; B26D 1/46; B26D 1/465; B26D 1/48; B26D 1/485; B26D 1/54; B26D 1/543; Y10T 83/707; Y10T 83/7183; Y10T 83/7226; Y10T 83/7233; Y10T 83/7239; Y10T 83/7245; Y10T 83/7251; Y10T 83/7258
USPC ..... 83/788, 807, 814–819; 30/380
See application file for complete search history.

(56) References Cited

U.S. PATENT DOCUMENTS 1,416,355 A 5/1922 Johnson
2,700,402 A 1/1955 Walden
(Continued)

FOREIGN PATENT DOCUMENTS

JP 3-15093 2/1991
JP 6-278853 A 10/1994
(Continued)

OTHER PUBLICATIONS

Japanese Office Action dated Apr. 8, 2014 with English Translation.

*Primary Examiner* — Phong Nguyen
(74) *Attorney, Agent, or Firm* — McGinn IP Law Group, PLLC.

(57) ABSTRACT

A bread slicing apparatus includes a plurality of drums disposed spaced apart from each other and adapted to be wound with an endless blade for slicing a loaf of bread, a plurality of rotation shafts on which the plurality of drums are coaxially mounted, respectively, a shaft support member including one end portion pivotably mounted and another end portion removably mounted, and the shaft support member being arranged to support at least one end portion of the plurality of rotation shafts, and a drum placement mechanism provided with a guide member by which opposed ends of the at least one of the plurality of rotation shafts are supported.

13 Claims, 7 Drawing Sheets

(51) Int. Cl.
*B26D 7/26* (2006.01)
*B26D 7/32* (2006.01)

(52) U.S. Cl.
CPC ..... *B26D 2007/327* (2013.01); *B26D 2210/06* (2013.01); *Y10T 83/707* (2015.04); *Y10T 83/7183* (2015.04)

(56) References Cited

U.S. PATENT DOCUMENTS

| | | | |
|---|---|---|---|
| 2,795,254 | A | 6/1957 | Hill |
| 2,963,054 | A | 12/1960 | Eschenburg |
| 3,036,408 | A | 5/1962 | Hansen |
| 3,145,745 | A | 8/1964 | Benith |
| 3,425,170 | A | 2/1969 | Simmons et al. |
| 3,638,521 | A | 2/1972 | Marckx et al. |
| 3,886,827 | A | 6/1975 | McCarthy |
| 4,694,715 | A | 9/1987 | Jongerius |
| 5,031,497 | A | 7/1991 | Moshier et al. |
| 7,789,004 | B2 | 9/2010 | Liao |
| 7,836,807 | B2 | 11/2010 | Jourdan |
| 8,381,624 | B2 | 2/2013 | Donovan et al. |

FOREIGN PATENT DOCUMENTS

| | | | |
|---|---|---|---|
| JP | H07-060687 | A | 3/1995 |
| JP | 11-90890 | A | 4/1999 |

BREAD SLICING APPARATUS

The present application is a Continuation application of U.S. patent application Ser. No. 12/968,071, filed on Dec. 14, 2010, which is based on and claims priority from Japanese patent application No. 2010-130432, filed on Jun. 7, 2010, the entire contents of which are incorporated herein by reference.

BACKGROUND OF THE INVENTION

1. Field of the Invention

The present invention relates to a bread slicing apparatus for slicing the bread. In particular, the present invention relates to a bread slicing apparatus that can facilitate attachment and detachment of endless blades.

2. Description of the Related Art

Loaf bread slicing apparatuses for slicing the loaf bread have been conventionally used. For example, U.S. Pat. No. 2,795,254 discloses a loaf bread slicer in which both ends in the axial direction of a rotation shaft to which a drum is mounted are supported by a double end-supported beam frame. The conventional loaf bread slicer comprises a pair of drums, a frame supporting the rotation shafts of both drums so that both drums can rotate in parallel to each other, and a plurality of endless blades that are wound diagonally across both drums disposed in parallel.

This frame is of a double end-supported beam type that comprises a pair of side frames extending with being slightly inclined with respect to the vertical direction and a beam frame horizontally extending and connected to the pair of side frames so that the side frames are arranged in parallel. Between the side frames, there is a pivot shaft extending in parallel to the beam frame. Both ends of the shaft of the drum are pivotably supported with respect to the pivot shaft via arm members, respectively. By swinging the arm members about the pivot shaft, the distance between the drums is changed, so that the tension applied to the endless blades is changed.

In the loaf bread slicer as arranged above, a plurality of endless blades are wound around both drums with being spaced apart from each other by a predetermined interval, and the loaf bread passing through the endless blades is sliced in the predetermined thickness.

Since the conventional loaf bread slicer has the side frames, the arm members supported by the rotation shaft, and the pivot shafts for swinging the arm members, it takes a lot of trouble in detaching and attaching the endless blades. For example, in order to replace the endless blade on the drums, it is required to remove the rotation shafts from the arm members, and take out and in the endless blade via a relatively narrow space between the arm members and the end face located in the axial direction of the drums.

As described above, in the bread slicing apparatus having the conventional frame-shaped beam frame, since the access to the rotation shaft of the drum and its peripheral portions is limited, it tends to take a lot of trouble for the maintenance and the replacement of the endless blades.

SUMMARY OF THE INVENTION

The present invention is provided to address the above situation. That is, the purpose of the present invention is to provide a bread slicing apparatus that can improve the access to the endless blades and the rotation shaft of the drum and its peripheral space and facilitate replacement and maintenance of the endless blade.

In order to solve the above problems and achieve the purposes, a bread slicing apparatus of the present invention comprises: a plurality of drums disposed spaced apart from each other and adapted to be wound with an endless blade; a plurality of rotation shafts on which the plurality of drums are coaxially mounted, respectively; a shaft support frame member extending outside a cylindrical space defined by an outer circumference surface and its extending surface of the plurality of drums; a shaft support member including one end portion pivotably mounted on the shaft support frame member and another end portion removably mounted on the shaft support frame member, and the shaft support member being capable of supporting at least one end portion of the plurality of rotation shafts; and a drum placement mechanism capable of placing at least one of the plurality of drums thereon, wherein the shaft support member is capable of pivoting between inside of the cylindrical space and outside of the cylindrical space, and the shaft support member is capable of pivoting toward the outside of the cylindrical space when the at least one of the plurality of drums is placed on the drum placement mechanism.

It is noted that, throughout the present specification, that the shaft support member or the shaft support frame member is located outside the cylindrical space S means that the entirety of the shaft support member or the shaft support frame member is located outside the cylindrical space S. In other words, when a part of the shaft support member or the shaft support frame member is located inside the cylindrical space S, this means that the shaft support member or the shaft support frame member extends within the cylindrical space S.

According to the bread slicing apparatus of the present invention, the shaft support member is pivotable with respect to the shaft support frame member and thus can move from an outside (or inside) of the cylindrical space defined by the outer surface and its extending surface of the drum to an inside (or outside) thereof. Therefore, obstacles such as the conventional arm member that would otherwise exist near the rotation shaft of the drum can be eliminated, which ensures the access to the endless blades and the space for attaching or detaching the endless blades. Further, this arrangement allows the easier maintenance of the drum and the parts disposed near the drum.

Further features of the present invention will become apparent from the following description of exemplary embodiments with reference to the attached drawings.

DESCRIPTION OF THE EMBODIMENTS

Figure 1:
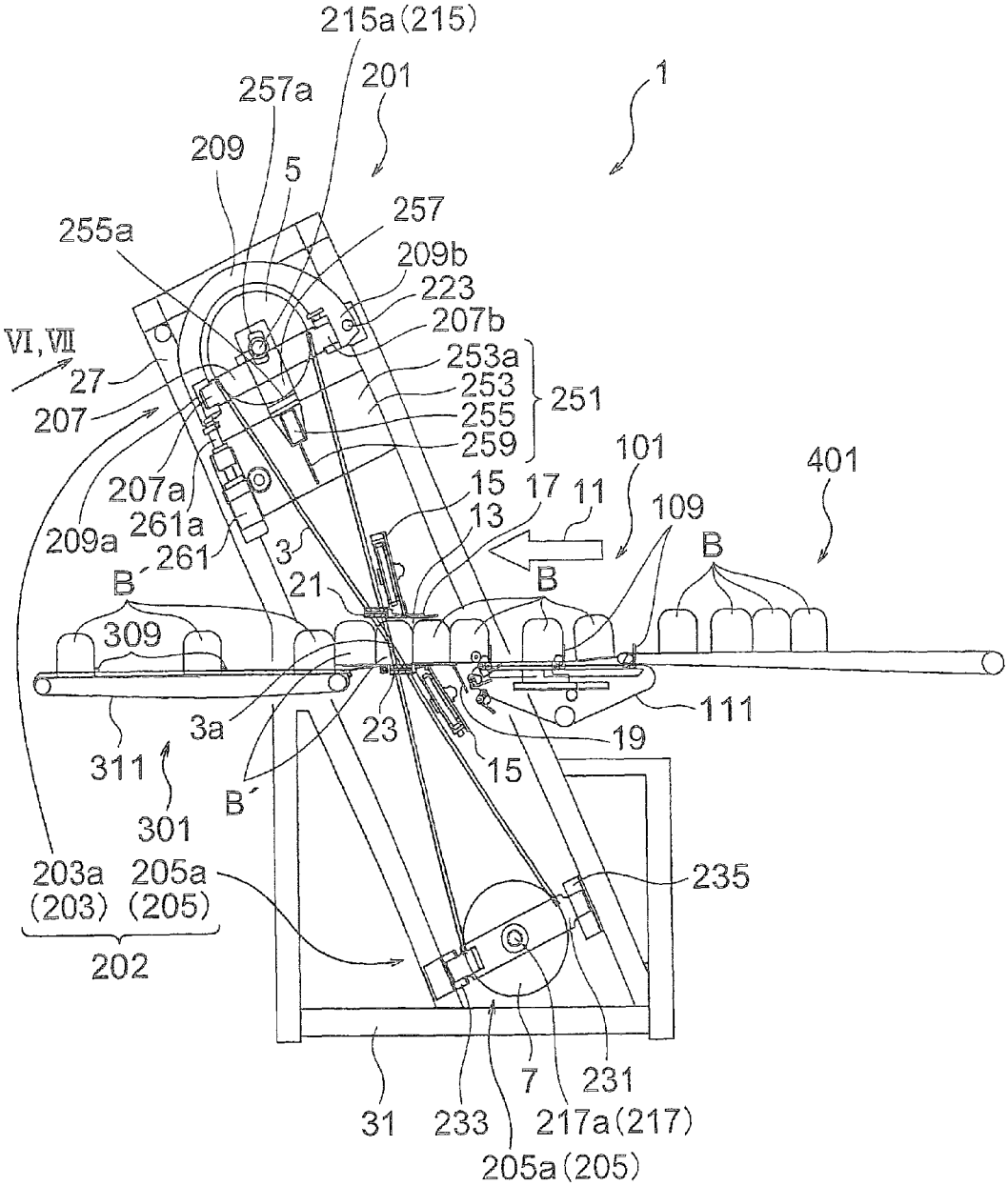
FIG. 1 is a side view that schematically shows primary components of a loaf bread slicing apparatus according to an embodiment.

Preferred embodiments of the present invention will now be described in detail in accordance with the accompanying drawings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

By referring to the drawings, below will be described a loaf bread slicing apparatus of an embodiment where a bread slicing apparatus according to the present invention is applied.

Figure 2:
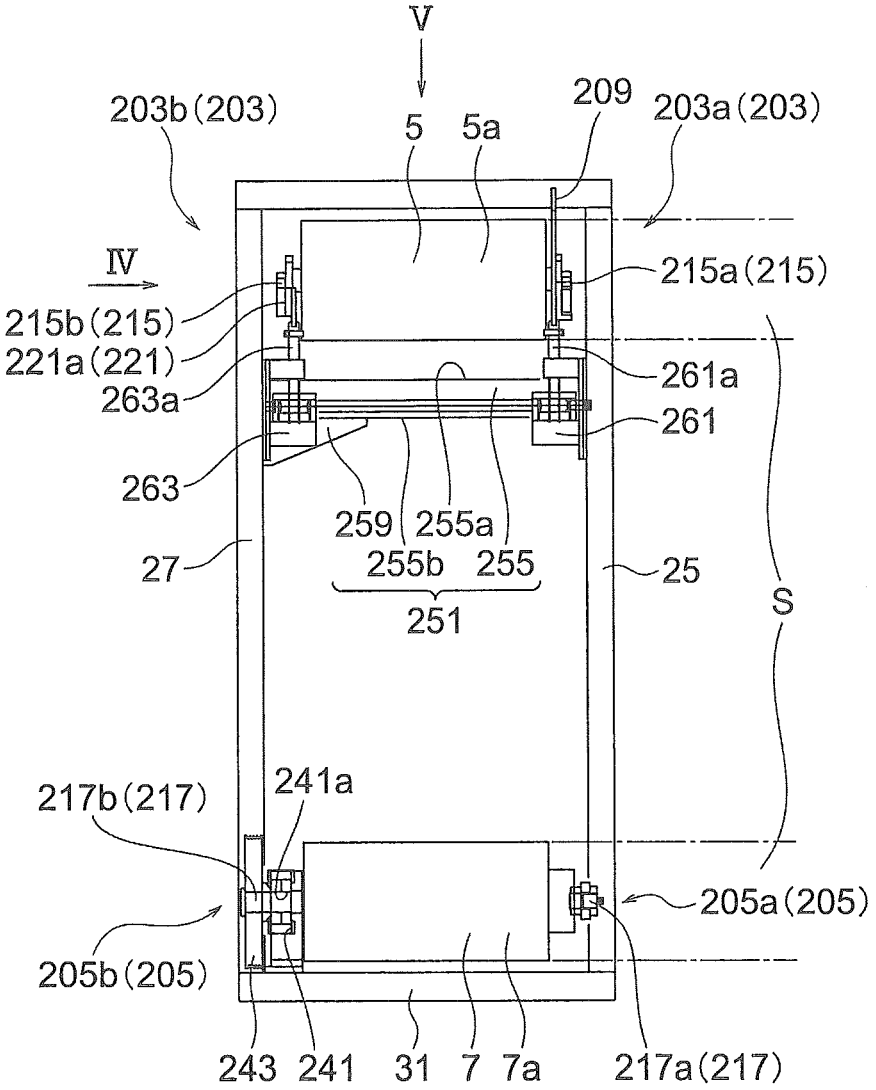
FIG. 2 is a front view of the loaf bread slicing apparatus of FIG. 1.
Figure 3:
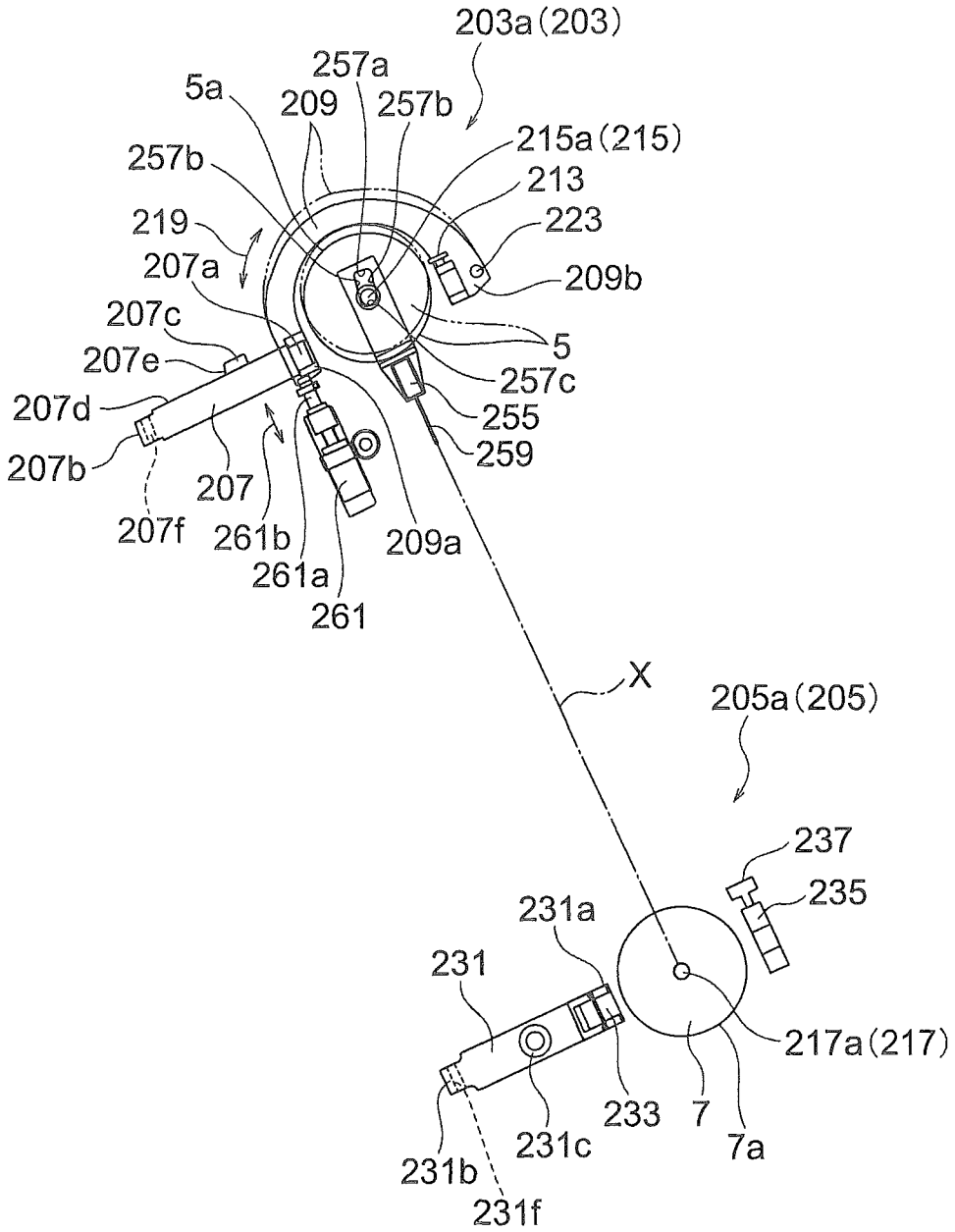
FIG. 3 is a side view showing an upper-right and a lower-right bread slicing drum support members when the arm members of FIG. 1 are opened.
Figure 4:
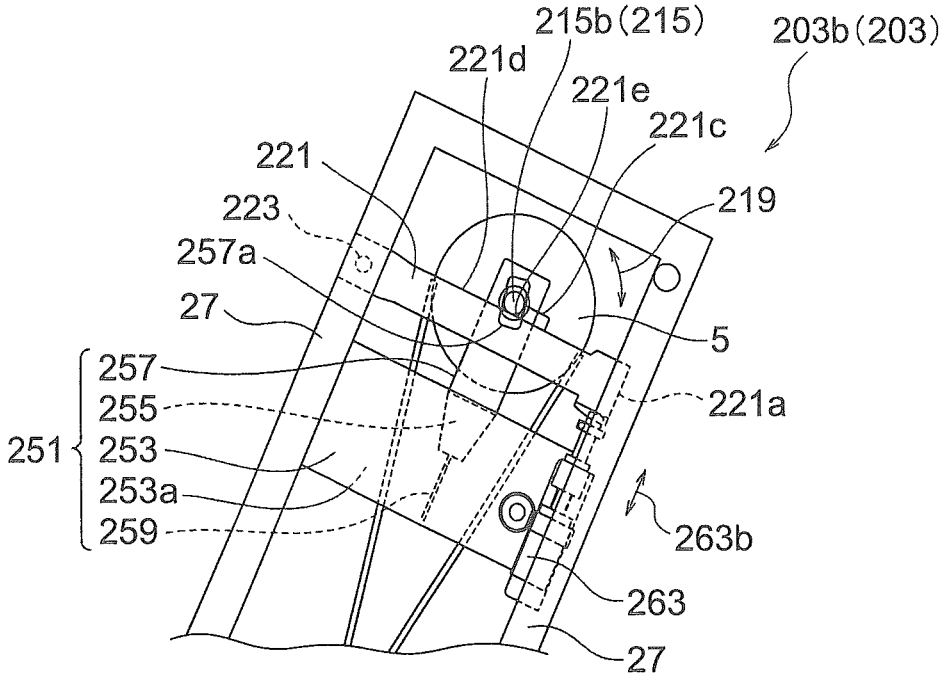
FIG. 4 is a side view of the upper-left bread slicing drum support member viewed from the direction of an arrow IV of FIG. 2.
Figure 5:
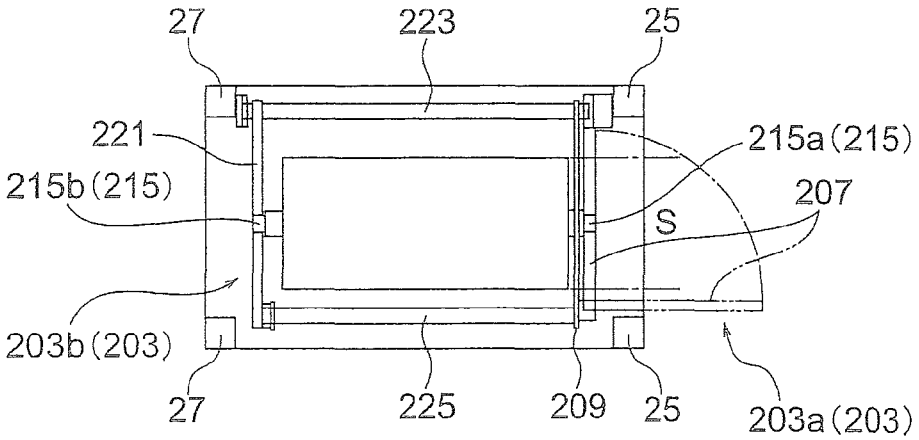
FIG. 5 is a plane view of the loaf bread slicing apparatus viewed from the direction of an arrow V of FIG. 2.
Figure 6:
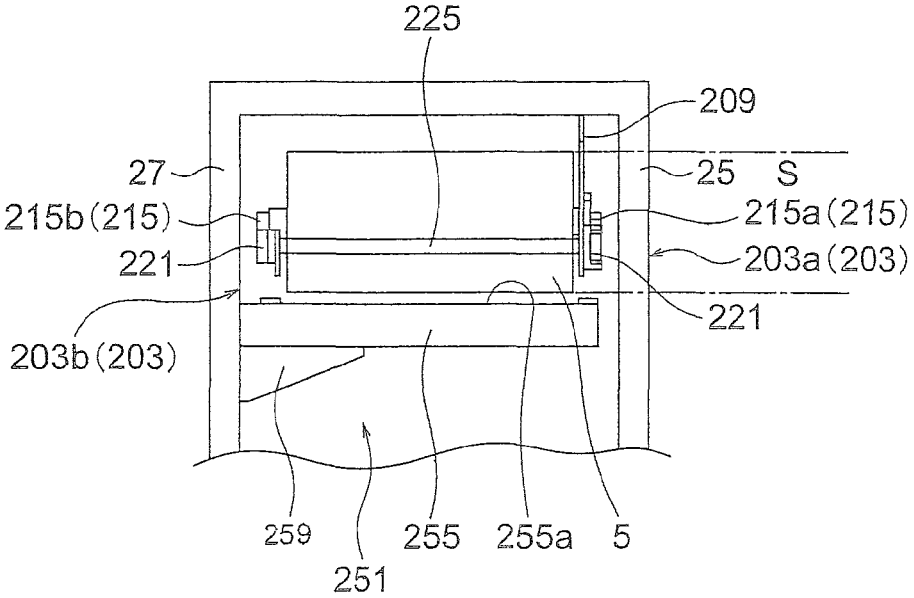
FIG. 6 is a front view of the bread slicing drum support unit viewed from the direction of an arrow VI of FIG. 1.
Figure 7:
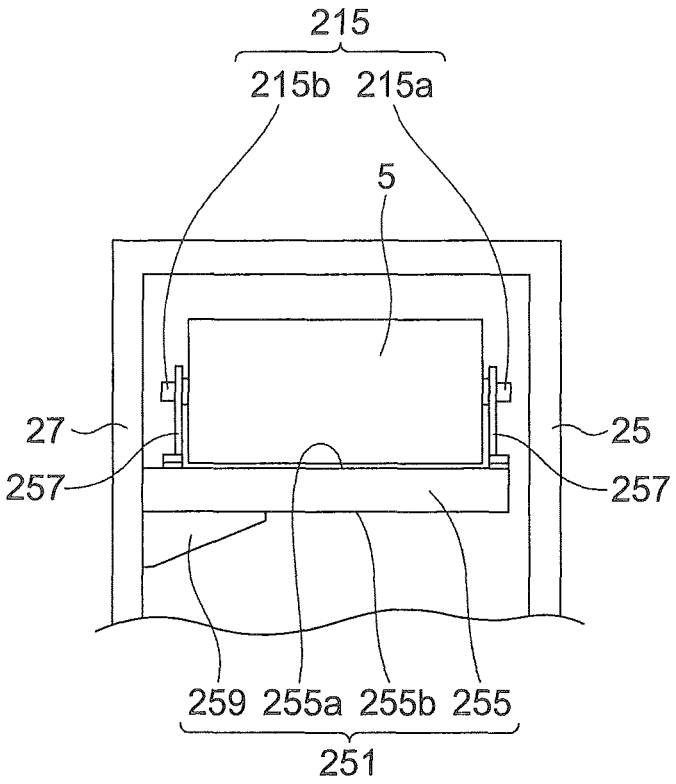
FIG. 7 is a front view of the drum placement mechanism viewed from the direction of an arrow VII of FIG. 1.

FIG. 1 is a side view that schematically shows the primary components of a loaf bread slicing apparatus 1 according to the embodiment; FIG. 2 is a front view of the loaf bread slicing apparatus 1 of FIG. 1; FIG. 3 is a side view showing an upper-right and a lower-right bread slicing drum support members 203*a* and 205*a* when the arm members of FIG. 1 are opened; FIG. 4 is a side view of the upper-left bread slicing drum support member 203*b* viewed from the direction of the arrow IV of FIG. 2; FIG. 5 is a plane view of the loaf bread slicing apparatus 1 viewed from the direction of the arrow V of FIG. 2; FIG. 6 is a front view of the bread slicing drum support member 203 viewed from the direction of the arrow VI of FIG. 1; and FIG. 7 is a front view of the drum placement mechanism 251 viewed from the direction of the arrow VII of FIG. 1.

It is noted that, for the clarity, the side frame 25 shown in FIG. 2 is omitted from FIG. 1. In FIG. 2, for the clarity, the selected elements only are shown that are necessary for the explanation, such as a bread slicing drum support unit 202, an upper and a lower drums 5 and 7, frames 25 and 27 of the loaf bread slicing apparatus 1, and so on. Also, the guide member 257 is omitted from FIG. 6, and the bread slicing drum support member 203 is omitted from FIG. 7.

The loaf bread slicing apparatus 1 mainly comprises a bread slicing unit 201 for slicing a loaf bread B; a bread conveying unit 101 for supplying the loaf bread B to the bread slicing unit 201; and a discharge conveyer 301 for conveying the loaf bread B' sliced by the bread slicing unit 201 to the subsequent process for bagging the sliced loaf bread B'. It is noted that, in FIG. 1, the element denoted by reference numeral 401 is a belt conveyer 401 for conveying the loaf bread B from the apparatus of the preceding process to the loaf bread slicing apparatus 1, and is not the element constituting the loaf bread slicing apparatus 1.

The bread slicing unit 201 will be described by referring to FIG. 1. The bread slicing unit 201 mainly comprises a bread introducing path 13 to which the loaf bread B is introduced; an upper drum 5 and a lower drum 7 disposed above and below the bread introducing path 13; a plurality of endless blades 3 wound diagonally across the upper drum 5 and the lower drum 7; an upper and a lower guide pins 21 and 23 for supporting the endless blades 3 so that the endless blades 3 can revolve at a predetermined position; a bread slicing drum support unit 202; and a drum placement mechanism 251.

The bread introducing path 13 is structured in a tunnel-like shape by a top plate 17 and a bottom plate 19 that define the size with respect to the upper-lower direction of the bread introducing path 13 and side plates (not shown) that define the size with respect to the front-back direction (penetrating the drawing sheet) of FIG. 1. The top plate 17 and the bottom plate 19 are fixed to a slicing unit frame 15 constituting the frame member of the bread slicing apparatus 1.

As shown in FIG. 2, the bread slicing drum support unit 202 comprises an upper bread slicing drum support member 203 disposed close to the upper drum 5 and a lower bread slicing drum support unit 205 disposed close to the lower drum 7. Further, the upper and lower bread slicing drum support members 203 and 205 are disposed at right end portions 215*a* and 217*a* and left end portions 215*b* and 217*b* of an upper and a lower rotation shafts 215 and 217. The right end portion 215*a* (217*a*) and left end portion 215*b* (217*b*) of an upper (a lower) rotation shaft 215 (217) coaxially support the upper (lower) drum 5 (7) shown in FIG. 2, respectively. That is, the upper bread slicing drum support member 203 comprises an upper-right drum support member 203*a* adapted to be opened and closed and a fixed upper-left drum support member 203*b* not adapted to be opened. Further, the lower bread slicing drum support unit 205 comprises a lower-right drum support member 205*a* adapted to be opened and closed and a fixed lower-left drum support member 205*b* not adapted to be opened.

As shown in FIG. 3, the upper-right drum support member 203*a* comprises a shaft support member, i.e., a support bar 207 adapted to support the right end portion 215*a* of the rotation shaft 215 adapted to be wound with the endless blades 3; and a shaft support frame member, i.e., an arm member 209 on which one end portion 207*a* of the support bar 207 is pivotably mounted and the other end portion 207*b* of the support bar 207 is removably mounted.

A support protrusion 207*c* is provided at the position close to the one end portion 207*a* with respect to the center portion in the longitudinal direction of the support bar 207. The right end portion 215*a* of the rotation shaft 215 is supported by a concave portion 207*e* that is defined by the support protrusion 207*c* and a top surface 207*d* of the support bar 207. Further, the other end portion 207*b* of the support bar 207 is provided with a pinhole 207*f* penetrating through its shorter side direction. A fixing pin 213 of the arm member 209 that will be described later is inserted into this pinhole 207*f* and the support bar 207 is thus fixed to the arm member 209.

Also, the one end portion 207*a* of the support bar 207 is provided with a pinhole (not shown) penetrating through its shorter side direction. One end portion 209*a* of the arm member 209 is provided with a shaft member (not shown) extending in parallel to the inter-axis line X that is orthogonal to the axes of the upper rotation shaft 215 and the lower rotation shaft 217. The shaft member (not shown) of the arm member 209 is inserted into the through hole (not shown) provided to the one end portion 207*a* of the support bar 207, which allows the support bar 207 to pivot.

The arm member 209 is a C-shaped plate-like part having a slightly larger radius of curvature than that of an outer circumference surface 5*a* of the upper drum 5, and extends spaced apart from the perimeter edge of the outer circumference surface 5*a* of the upper drum 5 by a predetermined distance in the radius direction. The other end portion 209*b* of the arm member 209 is revolvably mounted on a swing shaft, i.e., a rear cross bar 223, that extends in its thickness direction (the front-back direction of the drawing sheet of FIGS. 1 and 3), which allows the arm member 209 to swing in the direction of the arrow 219. It is noted that, since the arm member 209 does not extend on the revolving track of the endless blades 3 between the upper drum 5 and the lower drum 7, the arm member 209 does not obstruct the revolving of the endless blades 3.

As shown in FIG. 4, the upper-left drum support member 203*b* comprises a support bar 221 extending in the direction across two side frames 27 extending in parallel. In the support bar 221, similarly to the support bar 207 of the upper-right drum support member 203*a*, a protrusion 221*c* is provided to a top surface 221*d*, and a left end portion 215*b* of the rotation shaft 215 is supported by a concave portion 221*e* defined by the top surface 221*d* and the protrusion 221*c*. Further, the other end portion 221*b* of the support bar 221 is revolvably mounted on the swing shaft, i.e., the rear cross bar 223.

As shown in FIG. 5, the arm member 209 of the upper-right drum support member 203*a* and the support bar 221 of the upper-left drum support member 203*b* are connected to a front cross bar 225 and the rear cross bar 223, respectively. The rear cross bar 223 is swingably mounted with respect to the side frames 25 and 27. Thus, the upper-right and the upper-left drum support members 203*a* and 203*b* are configured to swing together about the rear cross bar 223 as the swing shaft. Further, the arm member 209 of the upper-right drum support member 203*a* and the support bar 221 of the upper-left drum support member 203*b* are arranged to connect to the front cross bar 225 and the rear cross bar 223, so that the rigidity of the structure holding the upper drum 5 can be ensured. Thus, even if the upper drum 5 is swung, the axis center of the rotation shaft 215 is certainly maintained at a predetermined position.

As shown in FIG. 3, the lower-right drum support member 205*a* comprises a shaft support member, i.e., a support bar 231 for rotatably supporting a right end portion 217*a* of the lower rotation shaft 217; a support bar pedestal member 233 on which one end portion 231*a* of the support bar 231 is pivotably mounted; and a support bar latch member 235 on which the other end portion 231*b* is removably mounted. That is, the support bar pedestal member 233 and the support bar latch member 235 constitute the shaft support frame member. The support bar pedestal member 233 and the support bar latch member 235 are fixed to the side frame 25, respectively.

The support bar pedestal member 233 is provided with a shaft member (not shown) extending in parallel to the inter-axis line X, and the one end portion 231*a* of the support bar 231 is rotatably mounted on this shaft member, so that a hinge is constituted. Further, the other end portion 231*b* of the support bar 231 is provided with a pinhole 231*f* penetrating through its shorter side direction (in the inter-axis line X direction described above). The fixing pin 237 of the support bar latch member 235 is inserted into the pinhole 231*f*, so that the other end portion 231*b* of the support bar 231 is fixed to the support bar latch member 235. Further, the support bar 231 is provided with a cylindrical support member 231*c* having a through hole, and the right end portion 217*a* of the lower rotation shaft 217 is rotatably supported by the cylindrical support member 231*c* when the support bar 231 is fixed (closed) to the support bar latch member 235.

The lower-left drum support member 205*b* shown in FIG. 2 comprises a support bar 241 extending across both side frames 27 (see FIG. 1). Unlike the support bar 231 of the lower-right drum support member 205*a*, the support bar 241 is not adapted to pivot with respect to the side frame 27 but is fixed. Further, in the present embodiment, the left end portion 217*b* of the lower rotation shaft 217 penetrates a shaft support hole 241*a* of the support bar 241 and is rotatably supported by the support bar 241.

Further, the left end portion 217*b* of the lower rotation shaft 217 penetrating the shaft support hole 241*a* is connected to a driven V-shaped pulley 243. An endless belt (not shown) is wound around the driven V-shaped pulley 243 and a driving V-shaped pulley (not shown) and the rotation force from a drive motor (not shown) is transmitted thereto. Thus, the lower drum 7 is rotated by the rotation force from the drive motor. The rotation force of the lower drum 7 is transmitted to the upper drum 5 via the endless blades 3, the upper drum 5 and the lower drum 7 are rotated in the directions opposite to each other. It is noted that any known means may be used for the above described mechanism for rotating the lower drum 7.

As described above, in the present embodiment, only the support bars 207 and 231 of the upper-right and the lower-right drum support members 203*a* and 205*a* are adapted to pivot outside the cylindrical space S (where the rotation shafts 215 and 217 extend) defined by the outer circumference surfaces 5*a* and 7*a* of the upper and the lower drums 5 and 7 and their extending surfaces. When the endless blades 3 of the bread slicing apparatus 1 are attached and removed, there is no obstacle in the path which the endless blades 3 pass though, thereby allowing the easier operation for attaching or removing the endless blades 3. Further, by this arrangement, significantly easier access to the right end portions 215*a* and 217*a* and their nearby regions of the upper and the lower rotation shafts 215 and 217 of the upper and the lower drums 3 and 5 can be made.

Further, as shown in FIGS. 1, 2, and 7, in the present embodiment, the drum placement mechanism 251 is provided for temporarily placing the upper drum 3 when the right end portion 215*a* of the upper rotation shaft 215 is not supported by the support bar 207 (in the open state). The drum placement mechanism 251 comprises a base 253 extending between the side frames 27; a placement stage 255 connected to the base 253 and extending toward the upper rotation shaft 215; a pair of guide members 257 (see FIG. 7) extending orthogonally to a top surface 255*a* of the placement stage 255; and a rib 259, which is substantially triangle in the front view, connected orthogonally to a bottom surface 255*b* of the placement stage 255 and an inner surface 253*a* of the base 253.

Further, as shown in FIGS. 1 and 3, the placement stage 255 has an inverse trapezoidal shape in the side view, and the upper drum 5 removed from the support bar 207 can be placed on the top surface 255*a* of the placement stage 255.

Also, in FIG. 7, the guide member 257 which is disposed on the right has an L-shape in the front view, and the guide member 257 which is disposed on the left has an inverse L-shape in the front view. The elected portion of the guide member 257 is provided with a guide hole 257*a* that is substantially rectangular and penetrating through its thickness direction (FIGS. 1 and 3). The left and the right end portions 215*b* and 215*a* of the rotation shaft 215 are inserted into respective guide holes 257*a* of the pair of guide members 257. Further, the lower end portion of the guide hole 257*a* with respect to the upper-lower direction of FIGS. 3 and 4 is denoted by reference numeral 257*c*, and a pair of linear edge portions extending in the longitudinal direction of the guide hole is denoted by reference numeral 257*b*.

Further, as shown in FIGS. 2 to 4, below the one end portion 209*a* of the arm member 209 and the one end portion 221*a* of the support bar 221, pressing members 261 and 263 for swinging the arm member 209 and the support bar 221 in the direction of the arrow 219 are mounted on the side frames 25 and 27. By extending and retracting the pressing screws 261*a* and 263*a* of the pressing members 261 and 263 in the directions of the arrows 261*b* and 263*b*, the arm member 209 and the support member 221 can swing in the direction of the arrow 219 with respect to the rear cross bar 223 as a swing shaft.

In addition, when the arm member 209 and the support member 221 swing, the rotation shaft 215 of the upper drum 5 is positioned at a predetermined position along the guide hole 257*a* of the guide member 257. In the present invention, when the pressing screws 261*a* and 263*a* are extended by a predetermined amount (the state indicated by the double-dotted line of FIG. 3 and the state indicated in FIG. 6), a predetermined tension is applied to the endless blades 3 and the endless blades 3 are then ready for slicing the loaf bread B.

Further, when the pressing screws 261*a* and 263*a* are retracted (the state indicated in FIG. 7), the rotation shaft 215 falls along the guide hole 257*a*, and the upper drum 5 is placed on the placement stage 255 as shown in FIG. 7. At this time, the tension of the endless blades 3 is in a loosen state. Once the fixing pins 213 and 237, which have latched the support bars 207 and 231 to the arm member 209 and the support bar latch member 235, are removed and the support bars 207 and 231 are opened, then the endless blades 3 can be removed.

Further, also in the case where the support bar 207 is released from the right end portion 215*a* of the rotation shaft 215 of the upper drum 5, the shaft 215 is engaged in the lower end portion 257*c* of the guide hole 257*a* and also the flat portion (not shown) provided to the right end portion 215*a* of the rotation shaft 215 and extending in parallel with the linear edge portion 257*b* is engaged therein, so that the positioning of the rotation shaft 215 of the upper drum 5 is made on the placement stage 255 and the rotation of the rotation shaft 215 is regulated. Further, once the other end portion 207*b* of the support bar 207 has been mounted on the other end portion 209*b* of the arm member 209, the right end portion 215*a* of the rotation shaft 215 engages in the concave portion 207*e* of the support bar 207 and is supported.

Further, when the support bar 207 has been fixed to the arm member 209, even if the rotation shaft 215 is not engaged in the concave portion 207*e* of the support bar 207, once the arm member 209 has been moved upward the direction of the arrow 261*b* by the pressing member 261, the right end portion 215*a* of the rotation shaft 215 slides on the top surface 207*d* of the support bar 207 and then engages in the concave portion 207*e* due to the arm member 209 being inclined with respect to the horizontal direction. Once the rotation shaft 215 has been supported by the concave portion 207*e*, the upper drum 3 is positioned in the rotation center. Accordingly, the arrangement described above allows the significantly easier positioning of the rotation shaft 215 with respect to the support bar 207.

It is noted that the known air cylinder and hydraulic cylinder may be used as the pressing member.

Other components and their operations will be briefly explained below.

The upper guide pin 21 and the lower guide pin 23 shown in FIG. 1 are fixed to the slicing unit frame 15 such that they are vertically disposed with respect to a cross point 3*a* where the endless blades 3 intersect, and these pins 21, 23 guide the endless blades 3 to pass through a predetermined motion track. Further, the cross point 3*a* is positioned within the bread introducing path 13.

A bread conveying unit 101 is disposed upstream the bread slicing unit 201 with respect to the conveying direction 11 of FIG. 1. The introduction of the loaf bread B into the bread introducing path 13 is made by the first flight conveyer 103. The introduction to the first flight conveyer 103 is made at a predetermined timing by the first flight 109 mounted on the endless revolving member 111 that revolves around sprockets. The loaf bread B conveyed into the bread introducing path 13 pushes another loaf bread B that have already been supplied into the bread introducing path 13, and the pushed loaf bread B travels toward the cross point 3*a* of the endless blades 3. Once the loaf bread B has passed through the cross point 3*a* when the endless blades 3 are rotating, the sliced bread B' sliced in a predetermined thickness is obtained.

A discharge conveyer 301 is arranged downstream the bread slicing unit 201 with respect to the conveying direction 11 of FIG. 1. The sliced loaf bread B' is conveyed to the next process by a second flight 309 mounted on a second endless revolving unit 311 wound around sprockets of the discharge conveyer 301.

While the support bars 207 and 231 are pivotably mounted with respect to the arm member 209 and the support bar pedestal member 233 in the present embodiment, the bread slicing drum support unit of the present invention is not limited to that arrangement. As long as the support bars 207 and 231 are adapted to move from an inside of the cylindrical space S defined by the outer circumference surface of the drum and its extending surface with respect to the rotation shaft of the drum to an outside thereof and verse versa, various arrangements can be applied.

Further, the present invention uses the upper-right drum support member 203*a* constituted with the arm member 209 and the support bar 207. However, the upper-left drum support member 203*b* may also be arranged with the arm member 209 and the support bar 207. In addition, while the upper drum 5 is rotatably mounted with respect to the fixedly supported rotation shaft 215 in the present embodiment, the purpose of the present invention can be achieved as long as the rotation shaft and the upper drum can be rotated relatively to each other.

Figure 8A:
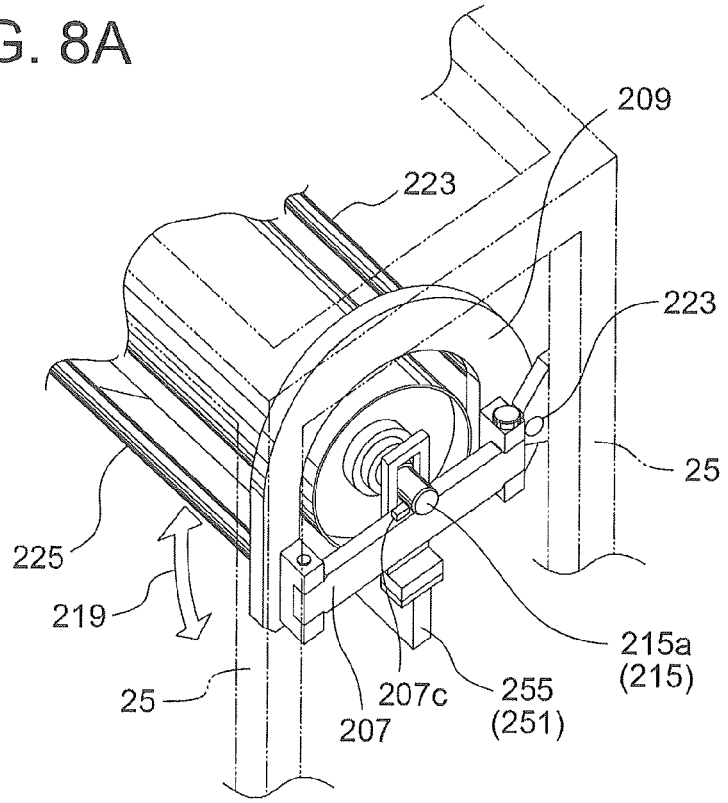
FIG. 8A is a perspective view of an upper left hand portion of bread slicing apparatus.
Figure 8B:
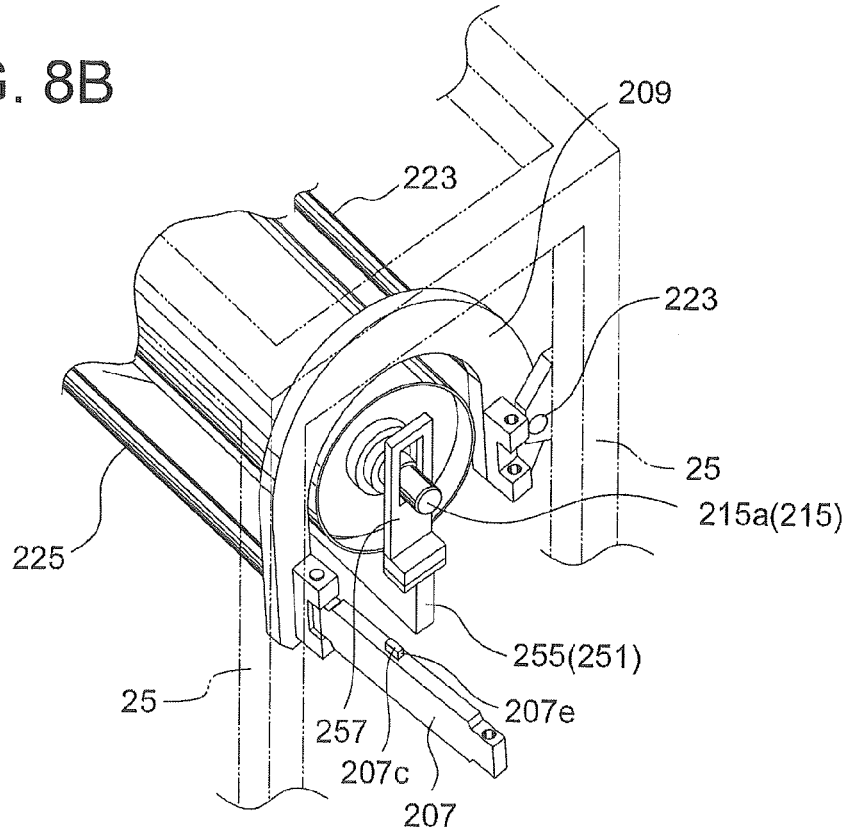
FIG. 8B is another perspective view of an upper left hand portion of bread slicing apparatus.

FIGS. 8A and 8B show a spatial relation between the side frame 27, the drum placement mechanism 251, the guide member 257, the support bar 207, and the arm member 209. Specifically, the upper one shows a state where the arm member 209 is upwardly positioned so that the endless blade is tensioned; the bottom one shows a state where the arm member 209 is downwardly positioned so that the endless blade is not tensioned so as to be replaced.

FIG. 8A is a perspective view of an upper left hand portion of bread slicing apparatus, illustrating a state (second position) where the arm member 209 is pivotally raised around a swing shaft (rear cross bar 223) so that that the endless blade would be tensioned for slicing a bread. In the second position, the rotation shaft 215 is supported by the guide hole of guide member 257 and the support bar 207.

FIG. 8B is a perspective view of an upper left hand portion of bread slicing apparatus, illustrating a state (first position) where the arm member 209 is pivotally lowered around the swing shaft (rear cross bar 223) so that that the endless blade would not be tensioned for slicing a bread. In the first position, while the rotation shaft 215 is supported by guide hole of guide member 257, the support bar 207 can is pivotally removed so as to replace the endless blade.

Further, while the present embodiment is described by using the loaf bread of the rectangular solid shape, the present invention is not limited to the apparatus used for the loaf bread, and thus can be applied to the bread conveying apparatus for conveying the breads of various sizes and shapes and the bread slicing apparatus for slicing these breads.

While the present embodiment is directed to the loaf bread slicing apparatus having the double end-supported beam frame, the present invention is not limited to this arrangement. It is clear that the present invention can be applied to the bread slicing apparatus having a side frame, so called cantilever, that extends toward one end of the rotation shaft only, which also allows the advantages of the present invention.

What is claimed is:

1. A bread slicing apparatus, comprising:

a plurality of drums disposed spaced apart from each other and adapted to be wound with an endless blade for slicing a loaf of bread;

a plurality of rotation shafts on which the plurality of drums are coaxially mounted, respectively;

a shaft support member including one end portion pivotably mounted and another end portion removably mounted, and the shaft support member being arranged to support at least one end portion of the plurality of rotation shafts; and a drum placement mechanism provided with a guide member by which opposed ends of the at least one of the plurality of rotation shafts are supported, wherein the shaft support member is arranged to pivot between a first position where a predetermined tension for slicing the bread is not applied to the endless blade, the another end portion of the shaft support member is removed and the at least one end portion of the plurality of rotation shafts is not supported by the shaft support member, and the opposed ends of the at least one of the plurality of rotation shafts are supported by the guide member, and a second position where the predetermined tension for slicing the bread is applied to the endless blade, the another end portion of the shaft support member is mounted, and the at least one end portion of the plurality of rotation shafts is supported by the shaft support member, and wherein the shaft support member is adapted to rotate around a rotational center extending in a direction crossing the at least one of the plurality of rotation shafts.

2. A bread slicing apparatus according to claim 1, wherein the shaft support member is provided in plural and is adapted to support respective one end portions of the plurality of rotation shafts, and wherein each of the plurality of shaft support members is adapted to support a same side of respective one end portions of the plurality of rotation shafts.

3. A bread slicing apparatus according to claim 2, wherein the guide member includes a pair of guide holes through which the opposed ends of one of the plurality of rotation shafts extend to be supported.

4. A bread slicing apparatus according to claim 3, wherein the shaft support member comprises a concave portion supporting at least one of the plurality of rotation shafts, and wherein a rotation center of at least one of the plurality of drums is positioned by the concave portion.

5. A bread slicing apparatus according to claim 2, wherein the shaft support member comprises a concave portion supporting at least one of the plurality of rotation shafts, and wherein a rotation center of at least one of the plurality of drums is positioned by the concave portion.

6. A bread slicing apparatus according to claim 1, wherein the guide member includes a pair of guide holes through which the opposed ends of one of the plurality of rotation shafts extend to be supported.

7. A bread slicing apparatus according to claim 6, wherein the shaft support member-comprises a concave portion supporting at least one of the plurality of rotation shafts, and wherein a rotation center of at least one of the plurality of drums is positioned by the concave portion.

8. A bread slicing apparatus according to claim 1, wherein the shaft support member comprises a concave portion supporting at least one of the plurality of rotation shafts, and wherein a rotation center of at least one of the plurality of drums is positioned by the concave portion.

9. A bread slicing apparatus according to claim 1, wherein said guide member extends in a direction crossing the shaft support member.

10. A bread slicing apparatus according to claim 9, wherein said guide member is provided with a pair of guide holes having a substantially rectangular shape, through which the opposed ends of the at least one of the plurality of rotation shafts are inserted.

11. A bread slicing apparatus according to claim 9, wherein said guide member is disposed closer to one of the plurality of drums associated with the at least one of the plurality of rotation shafts than the shaft support member with respect to an axis center direction of the at least one of the plurality of rotation shafts.

12. A bread slicing apparatus according to claim 1, wherein said guide member is disposed closer to one of the plurality of drums associated with the at least one of the plurality of rotation shafts than the shaft support member with respect to an axis center direction of the at least one of the plurality of rotation shafts.

13. A bread slicing apparatus according to claim 1, wherein the shaft support member extends in an inclined manner with respect to a horizontal direction and is provided with a support protrusion, and wherein a rotation center of at least one of the plurality of drums is positioned by the shaft support member and the support protrusion.

* * * * *